US010933663B2

(12) United States Patent
Kerxhalli

(10) Patent No.: US 10,933,663 B2
(45) Date of Patent: Mar. 2, 2021

(54) SYSTEM AND METHOD FOR RECIRCULATING PURGE MEDIA IN A SHEET PRINTER TO ATTENUATE THE DRYING OF INK FROM INKJETS IN A PRINTHEAD DURING PERIODS OF PARTIAL PRINTHEAD INACTIVITY

(71) Applicant: Xerox Corporation, Norwalk, CT (US)

(72) Inventor: David M. Kerxhalli, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 75 days.

(21) Appl. No.: 16/508,599

(22) Filed: Jul. 11, 2019

(65) Prior Publication Data

US 2021/0008907 A1 Jan. 14, 2021

(51) Int. Cl.
*B41J 13/00* (2006.01)
*B41J 2/165* (2006.01)

(52) U.S. Cl.
CPC ..... *B41J 13/0009* (2013.01); *B41J 2/16517* (2013.01)

(58) Field of Classification Search
CPC ..... B41J 13/0009; B41J 29/38; B41J 11/0095
USPC ..... 347/16, 101, 104, 105
See application file for complete search history.

(56) References Cited

U.S. PATENT DOCUMENTS 7,441,857 B2 * 10/2008 Murase ..... B41J 11/0085 271/181
7,924,443 B2 * 4/2011 Moore ..... G03G 15/6538 358/1.12
8,684,488 B2 * 4/2014 Kyotani ..... B41J 29/38 347/16
8,866,862 B2 10/2014 Arima
2005/0062792 A1 3/2005 Kojima
2011/0305851 A1 12/2011 Wang et al.

* cited by examiner

*Primary Examiner* — An H Do
(74) *Attorney, Agent, or Firm* — Maginot Moore & Beck LLP

(57) ABSTRACT

A method of operating a printer repetitively merges a purge sheet into a media stream of a job stream in the printer so the controller of the printer can operate inactive inkjets and eject ink onto the purge sheet to maintain the operational status of the inactive inkjets. The purge sheet has a width that is at least the maximum width of a print zone in the printer in the cross-process direction and a length that is less than a length of any media sheet in the job stream in the process direction. The purge sheet is diverted through a duplex path in the printer to repetitively merge the purge sheet into the media stream of the job stream to maintain the operational status of the inactive inkjets.

20 Claims, 3 Drawing Sheets

SYSTEM AND METHOD FOR RECIRCULATING PURGE MEDIA IN A SHEET PRINTER TO ATTENUATE THE DRYING OF INK FROM INKJETS IN A PRINTHEAD DURING PERIODS OF PARTIAL PRINTHEAD INACTIVITY

TECHNICAL FIELD

This disclosure relates generally to devices that produce ink images on media, and more particularly, to devices that eject fast-drying ink from inkjets to form ink images.

BACKGROUND

Inkjet imaging devices eject liquid ink from printheads to form images on an image receiving surface. The printheads include a plurality of inkjets that are arranged in some type of array. Each inkjet has a thermal or piezoelectric actuator that is coupled to a printhead controller. The printhead controller generates firing signals that correspond to digital data for images. Actuators in the printheads respond to the firing signals by expanding into an ink chamber to eject ink drops onto an image receiving member and form an ink image that corresponds to the digital image used to generate the firing signals.

Some inkjet imaging devices use inks that change from a low viscosity state to a high viscosity state relatively quickly. To prevent inkjets in a printhead from drying out during periods of printer inactivity, a capping station is used to cover the printhead and at least partially seal the faceplate of the printhead from ambient air to attenuate the evaporate of water or solvents in the ink at the nozzles. One situation of ink evaporation that cannot be addressed by a capping station occurs when a long print job or job stream forms ink images on media sheets that are less than a width of a print zone in a cross-process direction. As used in this document, the term "print zone" means the area directly opposite the printheads that has a length in a process direction from a first nozzle encountered by a sheet moving in the process direction to a last nozzle that the sheet passes as it moves in the process direction and has a width equal to the greatest distance between the most outboard nozzles on opposite sides of the print zone that are directly across from one another in the cross-process direction. The term "process direction" means the direction in which media sheets move through the print zone as the inkjets eject ink onto the sheets and the term "cross-process direction" means an axis that is perpendicular to the process direction in the plane of a media sheet in the print zone. When the width of the media sheets in the cross-process direction is less than a width of the print zone in the cross-process direction, the inkjets outside of the width of the media sheets are not used. Therefore, the ink at the nozzles of these inkjets is subject to a change in viscosity or evaporation that can adversely impact the operational status of the inkjets. If the ink dries completely, then the inkjet can become clogged and be incapable of ejecting any ink drops. Even if the ink at the nozzle only thickens, the path of the ink drops ejected by the inkjet can be altered and result in image quality defects arising from the errant ink drop paths.

To address this scenario, some of the sheets moving through the printer are not used for ink formation but rather inkjet resetting and restoration. The sheets used for this purpose are called "purge sheets" in this document. This inkjet resetting and restoration is achieved by firing all of the inkjets in all of the printheads at the sheet as it passes through the print zone. This firing helps ensure that fresh ink replaces the exposed ink at the nozzles. For inkjets outside the width of the media and for those that are infrequently used within the width of the media, the inkjet firing clears the nozzles to maintain or restore the operational status of the inkjets. The purge sheets are imaged by an optical sensor after the purge sheet exits the print zone and the image data of the purge sheet is analyzed by known methods to identify inkjets that have failed to return to operational status for two or more purge sheets. The inkjets that fail to return to operational status are identified and the printer controller generates a map of the failed inkjets and uses known missing inkjet compensation schemes to use alternative inkjets obfuscate the effects of the ink not ejected by the non-operational inkjets.

This ink purging helps restore clogged and inoperative inkjets to their operational status, although the amount of lost ink can be significant. Additionally, the purge sheets are removed from the printed media sheets and discarded. Depending on the length of the printing run, the number of purge sheets discarded may entail a cost that impacts the efficiency of the printing. Being able to improve the ability of the printer to preserve the operational status of most or all of the inkjets in the printheads when job stream parameters preclude regular use of all of the inkjets would be beneficial.

SUMMARY

A printer is configured to reduce the drying of ink at the nozzles of relatively unused inkjets during job streams more efficiently. The printer includes a supply of media sheets, a supply of purge sheets, a transport system for moving media sheets and purge sheets through the printer, at least one printhead for ejecting ink onto the media sheets and the purge sheets as the media sheets and the purge sheets pass by the at least one printhead, at least one receptacle positioned to received printed media sheets and purge sheets from the transport system, and a controller operatively connected to the transport system and the at least one printhead. The controller is configured to receive parameters for a job stream, determine whether a purge sheet is to be inserted into a media stream carried by the transport system for the job stream, identify at least one time for inserting the purge sheet in the media stream for the job stream and a time for discharging the purge sheet, and repetitively merging the purge sheet in the media stream until the identified time for discharging the purge sheet.

A method of operating an inkjet printer reduces the drying of ink at the nozzles of relatively unused inkjets during job streams more efficiently. The method includes receiving parameters for a job stream with a controller, determining with the controller whether a purge sheet is to be inserted into a media stream for the job stream, identifying with the controller at least one time for inserting the purge sheet in the media stream for the job stream and a time for discharging the purge sheet, and repetitively merging the purge sheet in the media stream until the identified time for discharging the purge sheet.

BRIEF DESCRIPTION OF THE DRAWINGS

The foregoing aspects and other features of a printer and printer operational method reduces the drying of ink at the nozzles of relatively unused inkjets during job streams more efficiently are explained in the following description, taken in connection with the accompanying drawings.

DETAILED DESCRIPTION

Figure 1:
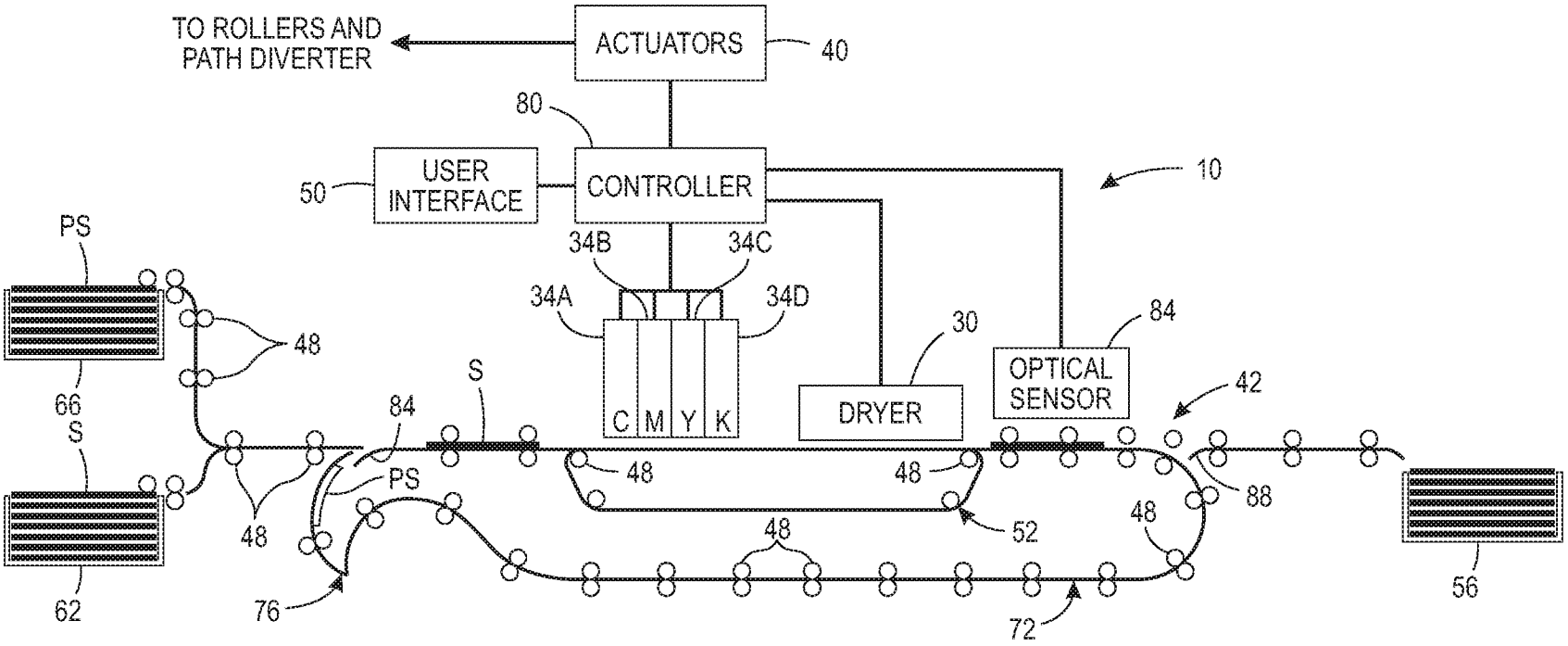
FIG. 1 is a schematic drawing of an inkjet printer that prints ink images directly on media sheets and recirculates a single purge sheet to attenuate evaporation of inks from the nozzles of the inkjets in the printheads of the printer during printing operations.

For a general understanding of the environment for the printer and printer operational method disclosed herein as well as the details for the printer and the printer operational method, reference is made to the drawings. In the drawings, like reference numerals have been used throughout to designate like elements. As used herein, the word "printer" encompasses any apparatus that produces ink images on media, such as a digital copier, bookmaking machine, facsimile machine, a multi-function machine, or the like. Also, the description presented below is directed to a system for preserving the operational status of inkjets in an inkjet printer during periods of printer use where some of the inkjets are not regularly used. The reader should also appreciate that the principles set forth in this description are applicable to similar imaging devices that generate images with pixels of marking material.

FIG. 1 illustrates a high-speed aqueous ink image producing machine or printer 10 in which a controller 80 has been configured to perform the process 400 described below to operate the printer so the ink at the nozzles of the printheads in the printhead modules 34A, 34B, 34C, and 34D maintain a low viscosity state during periods of inkjet inactivity during job streams. As illustrated, the printer 10 is a printer that directly forms an ink image on a surface of a media sheet S of media moved through the printer 10 by the controller 80 operating one or more of the actuators 40 that are operatively connected to rollers or to at least one driving roller of conveyor 52 that comprise the media transport 42. In one embodiment, each printhead module has only one printhead that has a width that corresponds to a width of the widest media in the cross-process direction that can be printed by the printer. In other embodiments, the printhead modules have a plurality of printheads with each printhead having a width that is less than a width of the widest media in the cross-process direction that the printer can print. In these modules, the printheads are arranged in an array of staggered printheads that enables media wider than a single printhead to be printed. Additionally, the printheads within a module or between modules can also be interlaced so the density of the drops ejected by the printheads in the cross-process direction can be greater than the smallest spacing between the inkjets in a printhead in the cross-process direction.

After an ink image is printed on the sheet S, the image passes under an image dryer 30. The image dryer 30 can include an infrared heater, a heated air blower, air returns, or combinations of these components to heat the ink image and at least partially fix an image to the web. An infrared heater applies infrared heat to the printed image on the surface of the web to evaporate water or solvent in the ink. The heated air blower directs heated air over the ink to supplement the evaporation of the water or solvent from the ink. The air is then collected and evacuated by air returns to reduce the interference of the air flow with other components in the printer.

As further shown, the printed media sheets S are carried by the media transport to the sheet receptacle 56 in which they are be collected. Before the printed sheets reach the receptacle 56, they pass by an optical sensor 84. The optical sensor 84 generates image data of the printed sheets and this image data is analyzed by the controller 80, which is configured to determine which inkjets, if any, that were operated to eject ink did in fact do so or if they did not eject an ink drop having an appropriate mass or that landed errantly on the sheet. Any inkjet operating in this manner is called an inoperative inkjet in this document. The controller can store data identifying the inoperative inkjets in a memory operatively connected to the controller. A user can operate the user interface 50 to obtain reports displayed on the interface that identify the number of inoperative inkjets and the printheads in which the inoperative inkjets are located. The optical sensor can be a digital camera, an array of LEDs and photodetectors, or other devices configured to generate image data of a passing surface. The media transport also includes a duplex path that can turn over and return a sheet to the transport prior to the printhead modules so the opposite of the sheet can be printed. As explained further below, this duplex path is used to house and occasionally insert an erasable media sheet at the position prior to the printhead modules for purging of relatively unused inkjets. While FIG. 1 shows the printed sheets as being collected in the sheet receptacle, they can be directed to other processing stations (not shown) that perform tasks such as folding, collating, binding, and stapling of the media sheets.

Operation and control of the various subsystems, components and functions of the machine or printer 10 are performed with the aid of a controller or electronic subsystem (ESS) 80. The ESS or controller 80 is operably connected to the components of the printhead modules 34A-34D (and thus the printheads), the actuators 40, and the dryer 30. The ESS or controller 80, for example, is a self-contained, dedicated mini-computer having a central processor unit (CPU) with electronic data storage, and a display or user interface (UI) 50. The ESS or controller 80, for example, includes a sensor input and control circuit as well as a pixel placement and control circuit. In addition, the CPU reads, captures, prepares, and manages the image data flow between image input sources, such as a scanning system or an online or a work station connection (not shown), and the printhead modules 34A-34D. As such, the ESS or controller 80 is the main multi-tasking processor for operating and controlling all of the other machine subsystems and functions, including the printing process.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either a scanning system or an online or work station connection for processing and generation of the printhead control signals output to the printhead modules 34A-34D. Additionally, the controller 80 determines and accepts related subsystem and component controls, for example, from operator inputs via the user interface 50 and executes such controls accordingly. Additionally, pixel placement control is exercised relative to the surface of the sheets S to form ink images corresponding to the image data and the printed media can be directed to the sheet receptacle or otherwise processed.

With further reference to FIG. 1, a supply of blank media sheets S is stored in receptacle 62. The sheets S in this receptacle are retrieved one at a time from the receptacle and fed to the transport system 42 where they are propelled by rollers or along the conveyor belt 52 by the dryer 30 and the printhead modules 34A, 34B, 34C, and 34D for printing and then directed to the receptacle 56 for collection or to other components for further processing. A second receptacle 66 is also connected by a feed path having rollers to the transport system 42 to insert purge sheets PS into the line of substrates S to be printed by the printer 10. As explained more fully below, these purge sheets are used repetitively during a job stream to maintain the viscosity of ink at the nozzles of printheads in the modules 34A, 34B, 34C, and 34D that are relatively unused during the job stream. The controller 80 is configured to operate the actuators 40 so the rollers in the feed path and the rollers from the receptacle 62 to the transport system 42 are driven selectively to insert a sheet from the purge sheet receptacle 66 into the stream of media sheets S on an as-needed-basis. A duplex path 72 is provided to receive a sheet from the transport system 42 after a substrate has been printed and move it by the rotation of rollers in an opposite direction to the direction of movement past the printheads. At position 76 in the duplex path 72, the substrate is turned over so it can merge into the job stream being carried by the media transport system 42. Movement of pivoting member 88 provides access to the duplex path 72. Rotation of pivoting member 88 is controlled by controller 80 selectively operating an actuator 40 operatively connected to the pivoting member 88. When pivoting member 88 is rotated counterclockwise as shown in FIG. 1, a substrate from media transport 42 is diverted to the duplex path 72. Rotating the pivoting member 88 in the clockwise direction from the diverting position closes access to the duplex path 72 so substrates on the media transport continue moving to the receptacle 56. Another pivoting member 84 is positioned between position 76 in the duplex path 72 and the media transport 42. When controller operates an actuator to rotate pivoting member 84 in the counterclockwise direction, a substrate from the duplex path 72 merges into the job stream on media transport 42. Rotating the pivoting member 84 in the clockwise direction closes the duplex path access to the media transport 42.

To maintain the viscosity of ink at the nozzles of inkjets that are sparingly used or not used at all during a job stream, at least one purge sheet PS is inserted into the train of media sheets S that are printed during a job stream. As used in this document, the term "job stream" means one or more print jobs that a printer performs in succession. Print jobs in a job stream can print on different types of media having different dimensions and even within a print job, different media types with different media dimensions can be printed. The purge sheet PS always has a width in the cross-process direction of the printer that extends across the entire print zone of the printer. Its length can range from the shortest possible length in the process direction up to one of the standard media sheet lengths. A shorter length keeps the cost of the purge sheets down and minimizes the productivity impact on the efficiency of the printer. The shortest length of a purge sheet is determined by the shortest distance between rollers in the media transport system 42 since contact between consecutive rollers along the transport path, outside the conveyer, is required to keep the sheets aligned and moving along the media transport. As used in this document, the term "process direction" means the direction of movement of the printhead as it ejects ink onto the object and the term "cross-process direction" means an axis that is perpendicular to the process direction in the plane of the process direction movement. The purge sheets are used for missing jet corrections as well as inkjet purging. For printers that have a recirculating duplex path, such as the one shown in FIG. 1, the purge media are diverted to the duplex path and occasionally reinserted into the media stream for the job stream so the purge sheet can be repetitively used during the job stream for missing inkjet correction and purging throughout the entire duration of the job stream.

Figure 2:
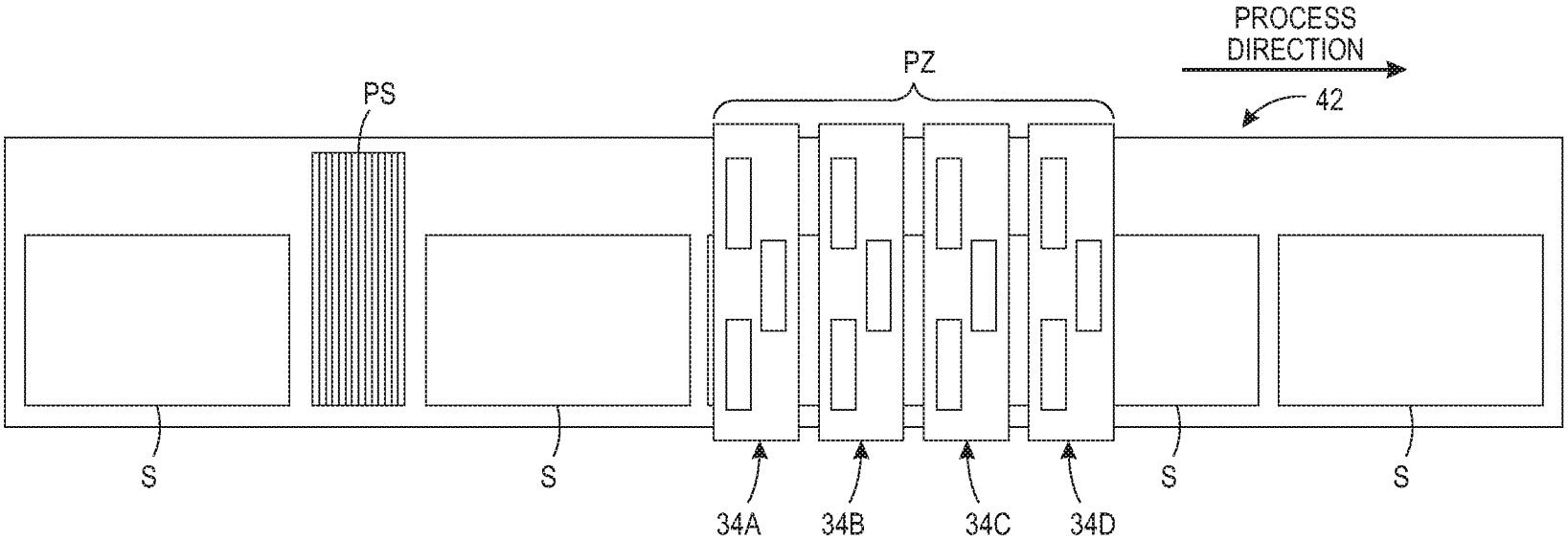
FIG. 2 is a top view of the print zone through which the single purge sheet passes to attenuate evaporation of inks from the nozzles of the inkjets in the printheads of the printer during printing operations.

The portion of the media transport 42 that extends from the exit of the dryer 30 past the print zone PZ is shown in FIG. 2. As previously noted, the print zone has a length in the process direction commensurate with the distance from the first inkjets that a sheet passes in the process direction to the last inkjets that a sheet passes in the process direction and it has a width that is the maximum distance between the most outboard inkjets on opposite sides of the print zone that are directly across from one another in the cross-process direction. As shown in FIG. 2, the media sheets S are not as wide as the print zone PZ in the cross-process direction. Consequently, the inkjets in the printheads under which no portion of a media sheet passes are not operated so the ink at the nozzles of these inkjets can begin to evaporate and dry. To address this problem, the purge sheet PS is inserted into the stream of media sheets S. The purge sheet PS extends across the entire width of the print zone PZ in the cross-process direction. The length of the purge sheet PS need only be as long as the longest distance between two consecutive rollers 48 in the media transport system 42 outside of the conveyor 52 to ensure that it is reliably moved by the media transport system and that it remains aligned with the print zone PZ as the media sheets S travel through the print zone. In one embodiment, this length is approximately eight inches. As the purge sheet PS passes through the print zone PZ, all of the inkjets in all of the printheads can be operated to eject ink drops onto the purge sheet. In the example shown in FIG. 2, module 34A prints one single line across the purge sheet, module 34B prints another line, module 34C prints another line, and module 34D prints another line. These four printed lines extend approximately 22 microns in the process direction in one embodiment. Consequently, very little area is consumed with the printing of the lines on the purge sheet. When the purge sheet PS passes the optical sensor 84, the sensor generates image data of these lines and the controller 80 analyzes this data as noted above to identify inoperative inkjets, if any, and store information regarding those inoperative inkjets in the memory operatively connected to the controller.

After the purge sheet PS passes the optical sensor 84, the controller 80 operates an actuator 40 to rotate the pivoting member 88 to divert the purge sheet PS into the duplex path 72 and then return the pivoting member to its position that blocks access to the duplex path. The duplex path 72 turns the purge sheet over at position 76 and then the scheduler of the controller 80 operates an actuator 40 to rotate the pivoting member 84 to provide access to the media transport 42, operates other actuators in the duplex path 72 to merge the purge sheet into the stream of media sheets for another pass through the print zone PZ, and then returns the pivoting member 84 to its position that supports media sheets as they pass over the member. The term "scheduler" as used in this document means a portion of the programmed instructions executed by the controller that cause the controller synchronize the movement of media sheets through the printer and the printing of the ink images on the sheets passing through the print zone. After a purge sheet has been merged into the stream of media sheets, it is again printed by all of the inkjets in the print zone, imaged, and returned to the duplex path 72 as long as the job stream continues. At or near the end of the job stream, the purge sheet continues along media transport 42 and is deposited in the receptacle 56 or diverted to another output receptacle, if one is available. The printed purge sheet PS can be culled from the job stream output and discarded or printed purge sheets can accumulate in the other receptacle until discarded to provide additional room for other purge sheets.

The purge sheets PS can be coated or uncoated card stock or other durable media to help ensure that the sheet is durable enough to be recirculated numerous times through the duplex path 72 and the print zone PZ. Since both sides of a purge sheet are printed multiple times but the length of the area used on a purge sheet is measured in tens of microns even the shortest sheet can be used repetitively during long job streams. While the printing of the purge sheet has been described above as being lines printed by all of the printheads in the printhead modules opposite the print zone, other patterns can be printed that absorb about the same amount of space during a pass through the print zone. For example, known test patterns could be printed to aid in the analysis of the operational status of the inkjets in the printheads. Also, the only inkjets fired to eject ink onto a purge sheet can be only those outside the cross-process direction width of the media sheets passing through the printer or it can include those inkjets plus any inkjets that are not being regularly used during the job stream. For instance, if the job stream is printing black and white images only, then all of the inkjets in the printheads ejecting colored ink can be operated as well as the black inkjets that are outside the margins of the media sheets S.

Figure 3:
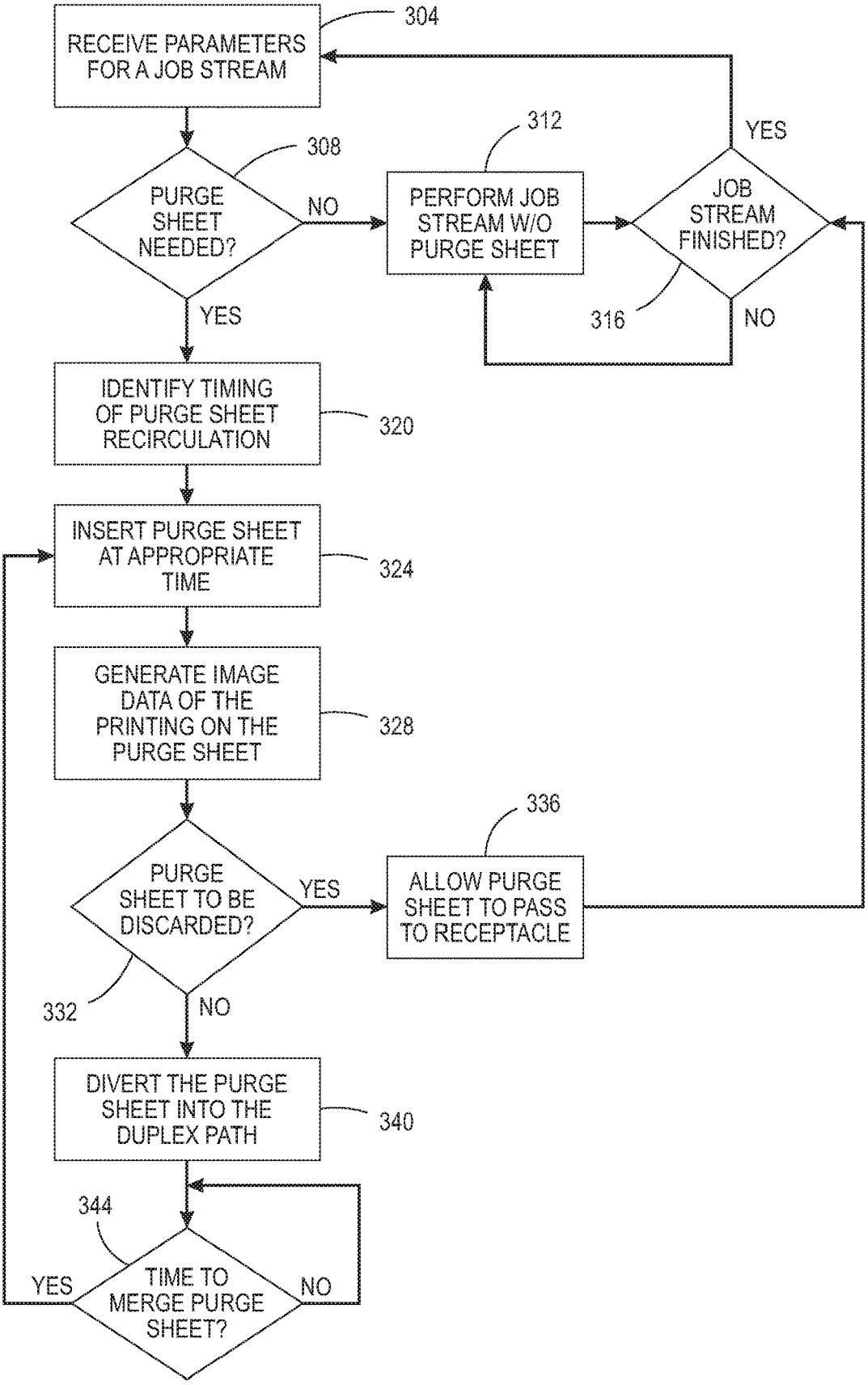
FIG. 3 is a flow diagram of a process for operating the printer of FIG. 1 to restore and preserve the operational status of the inkjets in the printheads of the printers.

FIG. 3 depicts a flow diagram for a process 300 that operates the printer 10 to insert a purge sheet in the media stream of a job stream and purge the relatively unused inkjets to preserve the viscosity of the ink in the nozzles of the relatively unused inkjets at the low viscosity. In the discussion below, a reference to the process 300 performing a function or action refers to the operation of a controller, such as controller 80, to execute stored program instructions to perform the function or action in association with other components in the printer. The process 300 is described as being performed with the printer 10 of FIG. 1 for illustrative purposes.

The process 300 of operating the printer 10 begins with the controller receiving the parameters for a job stream (block 304). The controller determines whether a purge sheet is to be used in the job stream (block 308). This determination is made when the width of the media sheets to be printed is less than the width of the print zone, the number of inkjets that are not used during a portion or all of the job stream is less than a predetermined number of inkjets, and the duration of the job stream is greater than a predetermined time period. If no purge sheet is needed, the job stream is performed without the use of a purge sheet (block 312) and when the job stream is finished (block 316), the controller waits for the parameters of the next job stream. If a purge sheet is useful during a job stream, then the scheduler of the controller determines the timing for the insertion of the purge sheet into the media sheet flow of the job stream (block 320). The job stream begins and the scheduler monitors the timing of the purge sheet insertion and inserts a purge sheet from the supply of purge sheets into the stream of media sheets at the expiration of the first time period or passing of the first number of sheets (block 324). After the purge sheet has passed through the print zone and been printed, it is imaged (block 328) and the scheduler of the controller determines whether the purge sheet is to be discharged (block 332). If it is to be discharged, then the purge sheet is allowed to continue in the media stream to a discharge receptacle (block 336). Otherwise, the controller operates actuators to divert the purge sheet into the duplex path and proceed through the duplex path where it is inverted for merger into the job stream (block 340). When the scheduler of the controller determines that the purge sheet has traversed the duplex path and is ready to be recirculated into the stream of media sheets (block 344), it operates the pivoting member and other actuators to merge the purge sheet into the media stream (block 324) and the job stream continues (blocks 328 to 344) until the purge sheet is to be discharged and is directed to an output receptacle (blocks 332 and 336). Once the job stream is finished (block 316), the controller waits for the parameters for the next print job (block 304).

In one embodiment, the scheduler of the controller is further configured to hold the purge sheet for scheduled merger of the purge sheet into the job stream from the duplex path 72. In this embodiment, the controller operates actuators to divert the purge sheet into the duplex path and hold the sheet for reinsertion at block 340 and when the scheduler of the controller determines that the time for merger of the purge sheet has expired at block 344, it operates the pivoting member and other actuators to propel the purge sheet into the media stream at block 324 and the job stream continues through the processing of blocks 328 to 344 until the purge sheet is to be discharged (blocks 332 and 336) and when the process determines the job stream is finished (block 316), the controller waits for the parameters for the next print job (block 304).

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method for operating a printer comprising:

receiving parameters for a job stream with a controller;

determining with the controller whether a purge sheet is to be inserted into a media stream for the job stream;

identifying with the controller at least one time for inserting the purge sheet in the media stream for the job stream and a time for discharging the purge sheet; and repetitively merging the purge sheet in the media stream until the identified time for discharging the purge sheet.

2. The method of claim 1 further comprising:

identifying a width of sheets in the media stream; and determining a purge sheet is to be inserted into the media stream when the width of the sheets in the media stream is less than a width of a print zone in the printer.

3. The method of claim 2 further comprising:

operating all of the inkjets in one or more of the printheads in the printer with the controller to eject ink onto the purge sheet as the purge sheet passes through a print zone of the printer.

4. The method of claim 2 further comprising:

operating inkjets in one or more of the printheads in the printer with the controller to eject ink onto the purge sheet as the purge sheet passes through a print zone of the printer to form a test pattern on the purge sheet.

5. The method of claim 4 further comprising:

generating with an optical sensor image data of the purge sheet bearing the ejected ink;

analyzing with the controller the image data generated by the optical sensor to identify inoperative inkjets; and storing the identification of the inoperative inkjets in a memory operatively connected to the controller.

6. The method of claim 5 further comprising:

diverting the purge sheet into a duplex path in the printer before repetitively merging the purge sheet into the media stream of the job stream.

7. The method of claim 6 wherein the purge sheet has a length that is less than a length of any media sheet in the media stream of the job stream.

8. The method of claim 7 wherein the purge sheet has a width that is at least equal to a width of the print zone.

9. The method of claim 1 further comprising:

identifying with the controller a number of inkjets not operated during the job stream; and determining with the controller when a purge sheet is to be merged into the media stream when the number of inkjets not operated during the print job is greater than a predetermined number.

10. The method of claim 1 further comprising:

determining with the controller when a purge sheet is to be merged into the media stream when a time for performing the job stream is greater than a predetermined time period.

11. A printer comprising:

a supply of media sheets;

a supply of purge sheets;

a transport system for moving media sheets and purge sheets through the printer;

at least one printhead for ejecting ink onto the media sheets and the purge sheets as the media sheets and the purge sheets pass by the at least one printhead;

at least one receptacle positioned to received printed media sheets and purge sheets from the transport system; and a controller operatively connected to the transport system and the at least one printhead, the controller being configured to receive parameters for a job stream, determine whether a purge sheet is to be inserted into a media stream carried by the transport system for the job stream, identify at least one time for inserting the purge sheet in the media stream for the job stream and a time for discharging the purge sheet, and repetitively merging the purge sheet in the media stream until the identified time for discharging the purge sheet.

12. The printer of claim 11, the controller being further configured to:

identify a width of sheets in the media stream; and determine a purge sheet is to be inserted into the media stream when the width of the sheets in the media stream is less than a width of a print zone in the printer.

13. The printer of claim 12, the controller being further configured to:

operate all of the inkjets in the at least one printhead to eject ink onto the purge sheet as the purge sheet passes through a print zone of the printer.

14. The printer of claim 12, the controller being further configured to:

operate inkjets in the at least one printhead to eject ink onto the purge sheet as the purge sheet passes through a print zone of the printer to form a test pattern on the purge sheet.

15. The printer of claim 14 further comprising:

an optical sensor configured to generate image data of the purge sheet bearing the ejected ink; and the controller is operatively connected to the optical sensor and the controller is further configured to:

analyze the image data generated by the optical sensor to identify inoperative inkjets; and store the identification of the inoperative inkjets in a memory operatively connected to the controller.

16. The printer of claim 15 further comprising:

a duplex path configured to receive a media sheet and a purge sheet from the media transport after the media sheet or purge sheet has been printed and invert the media sheet or purge sheet before merging the media sheet or purge sheet into the media stream of the job stream.

17. The printer of claim 16 wherein the purge sheet has a length that is less than a length of any media sheet in the media stream of the job stream.

18. The printer of claim 17 wherein the purge sheet has a width that is at least equal to a width of the print zone.

19. The printer of claim 11, the controller being further configured to:

identify a number of inkjets not operated during the job stream; and determine when a purge sheet is to be merged into the media stream when the number of inkjets not operated during the print job is greater than a predetermined number.

20. The printer of claim 11, the controller being further configured to:

determine when a purge sheet is to be merged into the media stream when a time for performing the job stream is greater than a predetermined time period.

* * * * *